US008707705B2

(12) United States Patent
Berry et al.

(10) Patent No.: US 8,707,705 B2
(45) Date of Patent: Apr. 29, 2014

(54) IMPINGEMENT COOLED TRANSITION PIECE AFT FRAME

(75) Inventors: Jonathan Dwight Berry, Greenville, SC (US); Kevin Weston McMahan, Greenville, SC (US)

(73) Assignee: General Electric Company, Schenectady, NY (US)

( * ) Notice: Subject to any disclaimer, the term of this patent is extended or adjusted under 35 U.S.C. 154(b) by 1185 days.

(21) Appl. No.: 12/553,153

(22) Filed: Sep. 3, 2009

(65) Prior Publication Data

US 2011/0048030 A1 Mar. 3, 2011

(51) Int. Cl.
*F02C 7/12* (2006.01)

(52) U.S. Cl.
USPC ..... 60/752; 60/39.83

(58) Field of Classification Search
USPC ..... 60/752–760, 805, 806, 39.83
See application file for complete search history.

(56) References Cited

U.S. PATENT DOCUMENTS 2,760,338 A 1/1953 Keast
4,719,748 A * 1/1988 Davis et al. ..... 60/39.37
4,872,312 A 10/1989 Iizuka et al.
5,125,796 A * 6/1992 Cromer ..... 415/174.2
6,412,268 B1 * 7/2002 Cromer et al. ..... 60/772
6,769,257 B2 8/2004 Kondo et al.
7,010,921 B2 3/2006 Intile et al.
7,727,354 B2 * 6/2010 Park et al. ..... 156/345.43
2010/0223931 A1 * 9/2010 Chila et al. ..... 60/760
2010/0236248 A1 * 9/2010 Kaleeswaran et al. ..... 60/752

OTHER PUBLICATIONS

Chinese Office Action issued Nov. 26, 2013 in CN2010-10287134.8, 8 pgs.
English Translation of Chinese Office Action issued Nov. 26, 2013 in CN2010-10287134.8, 11 pgs.

* cited by examiner

*Primary Examiner* — Andrew Nguyen
(74) *Attorney, Agent, or Firm* — Cantor Colburn LLP

(57) ABSTRACT

An aft frame of a turbine engine transition piece body is provided and includes an annular body disposed within a first annular space defined between an impingement sleeve and a compressor discharge casing and aft of a second annular space defined between the transition piece body and the impingement sleeve and including a main portion with a first surface facing the first annular space and a second surface facing the forward annular space. The main portion has an impingement hole extending therethrough from an inlet at the first surface of the annular body to an outlet at the second surface of the annular body to define a fluid path along which the first and second annular spaces communicate with one another.

18 Claims, 5 Drawing Sheets

IMPINGEMENT COOLED TRANSITION PIECE AFT FRAME

BACKGROUND OF THE INVENTION

The subject matter disclosed herein relates to an impingement cooled transition piece aft frame.

Gas turbine engines generally include a compressor, which compresses inlet air, and a combustor, coupled to the compressor, in which the compressed inlet air is combusted along with other combustible materials. A turbine is disposed downstream from the combustor to receive the combusted materials so that the energy of the combusted materials can be employed in the generation of, for example, electricity. A transition piece is typically disposed between the combustor and the turbine and forms a fluid pathway through which the combusted materials travel.

Recently, efforts have been undertaken to improve the performance of gas turbine engines by making them more efficient. Gas turbine engines with increased efficiencies experience several desirable results. Among them is the fact that efficient gas turbine engines tend to combust relatively high percentages of their input fuel. As such, they can then be operated at lower cost and with more control over emissions. Examples of these efforts include, but are not limited to, monitoring and controlling fuel mixtures and injection operations and modifications to compressor, combustor and turbine structures.

BRIEF DESCRIPTION OF THE INVENTION

According to one aspect of the invention, an aft frame of a turbine engine transition piece body is provided and includes an annular body disposed within a first annular space defined between an impingement sleeve and a compressor discharge casing and aft of a second annular space defined between the transition piece body and the impingement sleeve and including a main portion with a first surface facing the first annular space and a second surface facing the forward annular space. The main portion has an impingement hole extending therethrough from an inlet at the first surface of the annular body to an outlet at the second surface of the annular body to define a fluid path along which the first and second annular spaces communicate with one another.

According to another aspect of the invention, an aft frame of a turbine engine transition piece body is provided and includes an annular body disposed within a first annular space defined between an impingement sleeve and a compressor discharge casing and aft of a second annular space defined between the transition piece body and the impingement sleeve and including a main portion with a first surface facing the first annular space and a second surface facing the forward annular space. The main portion has an impingement hole extending therethrough from an inlet at the first surface of the annular body to an outlet at the second surface of the annular body to define a fluid path along which the first and second annular spaces exclusively communicate with one another.

According to yet another aspect of the invention, a turbine engine is provided and includes a compressor discharge casing (CDC), a transition piece body, an impingement sleeve disposed to delimit a first annular space with the CDC and a second annular space with the transition piece body and an annular body, connected to the transition piece body and the impingement sleeve to be disposed within the first annular space and aft of the second annular space, and including a main portion with a first surface facing the first annular space and a second surface facing the second annular space. The main portion has an impingement hole extending therethrough from an inlet at the first surface to an outlet at the second surface to define a fluid path along which the first and second annular spaces communicate with one another.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features without limitation, by way of example with reference to the drawings.

DETAILED DESCRIPTION OF THE INVENTION

Figure 1:
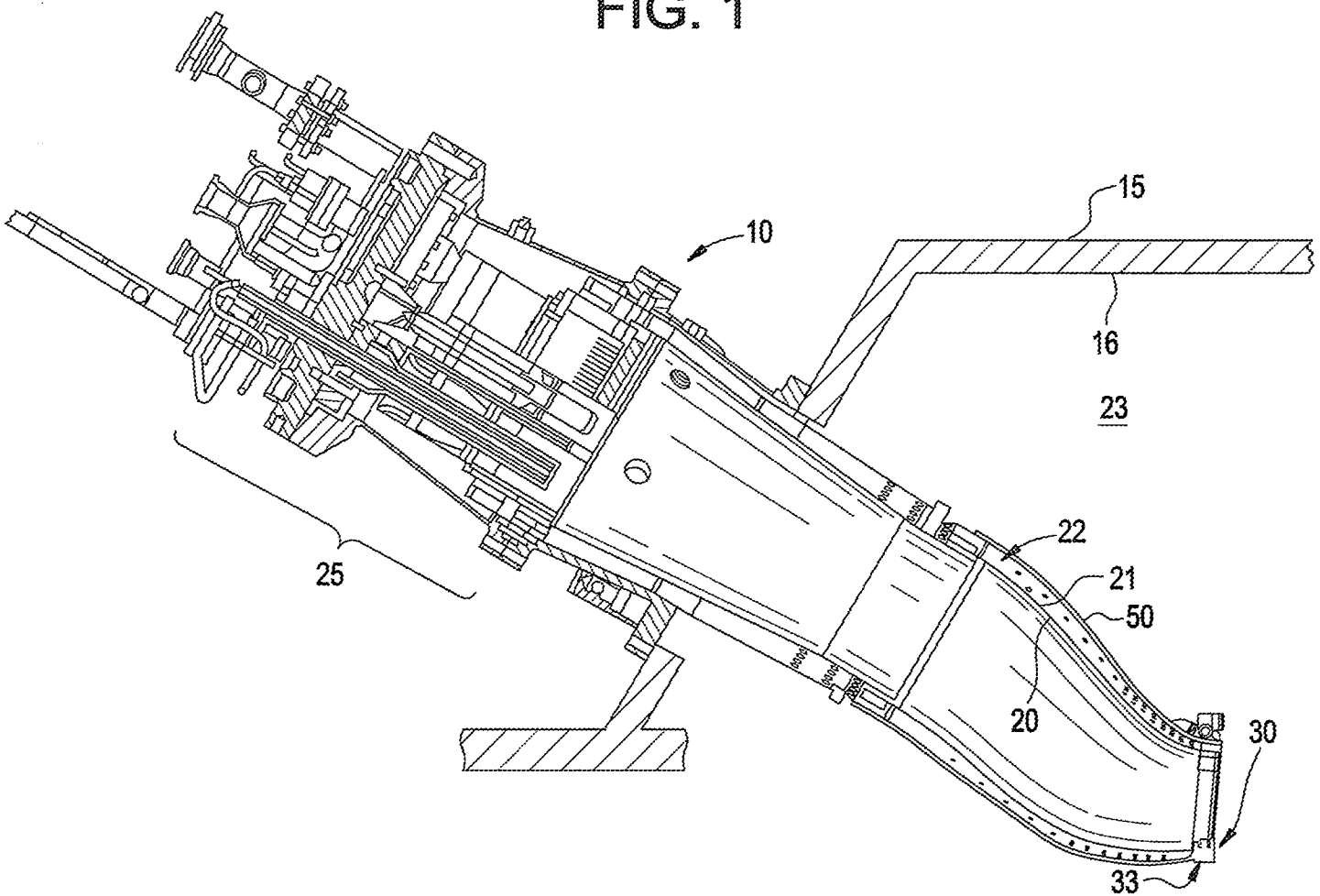
FIG. 1 is a sectional view of a section of a gas turbine combustor in accordance with embodiments of the invention.

With reference to FIG. 1, an impingement airflow cooling effect on an aft frame 30 can be achieved in a gas turbine engine 10. The turbine engine 10 may include a compressor discharge casing (CDC) 15, including an interior surface 16, which is receptive of high pressure impingement air from, for example, a compressor. A transition piece body 20, including an exterior surface 21, is disposed within the CDC 15. An impingement sleeve 50 is then disposed to delimit a first or, rather, an outer annular space 23 between the impingement sleeve 50 and the interior surface 16 of the CDC 15 and an outer surface 33 of the aft frame 30. The impingement sleeve 50 further delimits a second or, rather, a forward annular space 22 in cooperation with the exterior surface 21 of the transition piece body 20.

A head end 25 may be operably disposed upstream from the transition piece body 20 and may communicate with at least the forward annular space 22. The head end 25 may therefore receive impingement airflow (IA), which will have traveled through an impingement hole 60 of the aft frame 30 from the outer annular space 23 as will be described below.

Figure 2A:
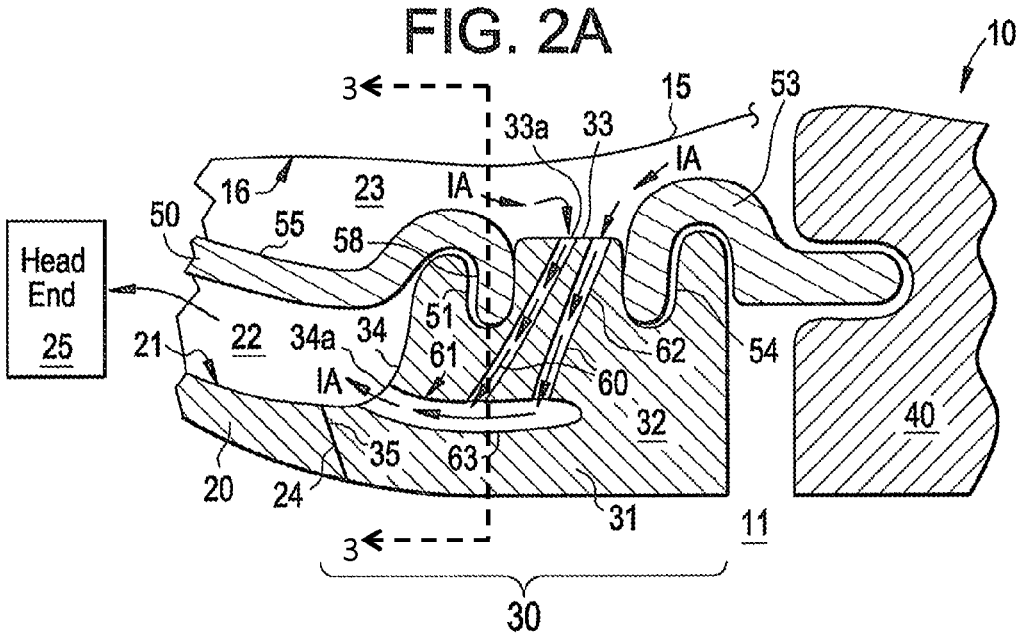
FIGS. 2A, 2B and 2C are sectional views of a portion of a transition piece aft frame.
Figure 2B:
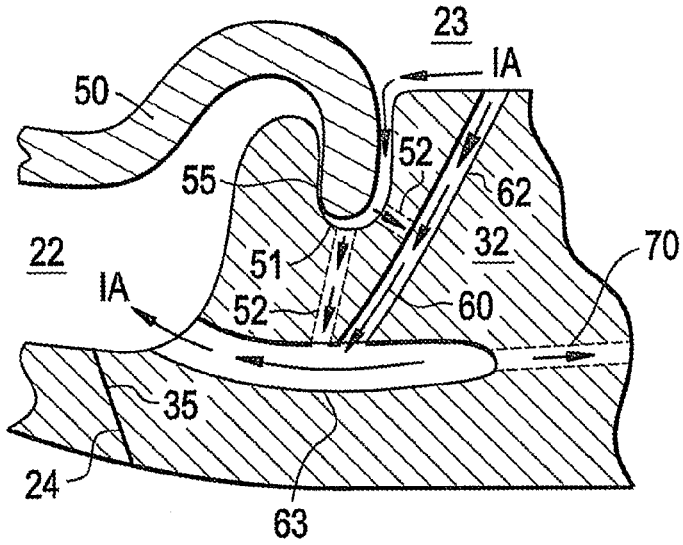
Figure 2C:
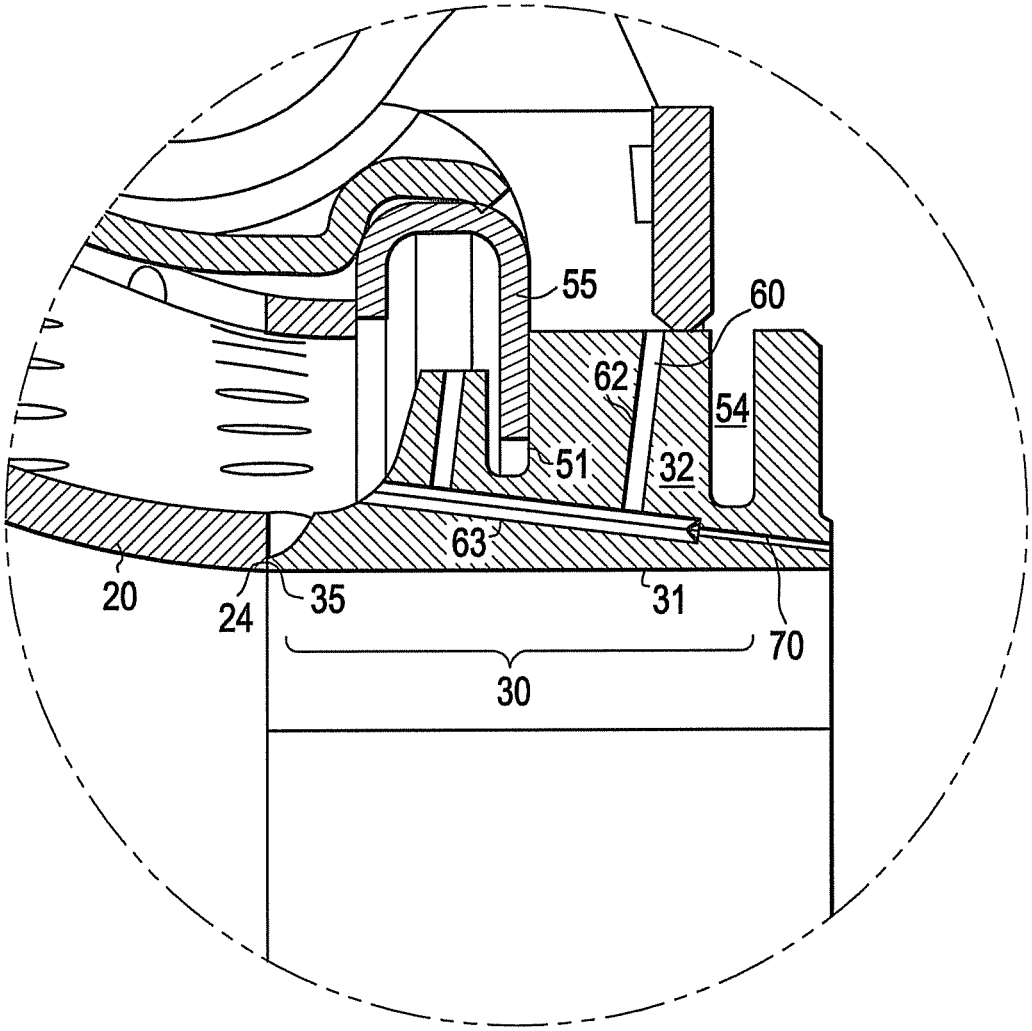
Figure 3:
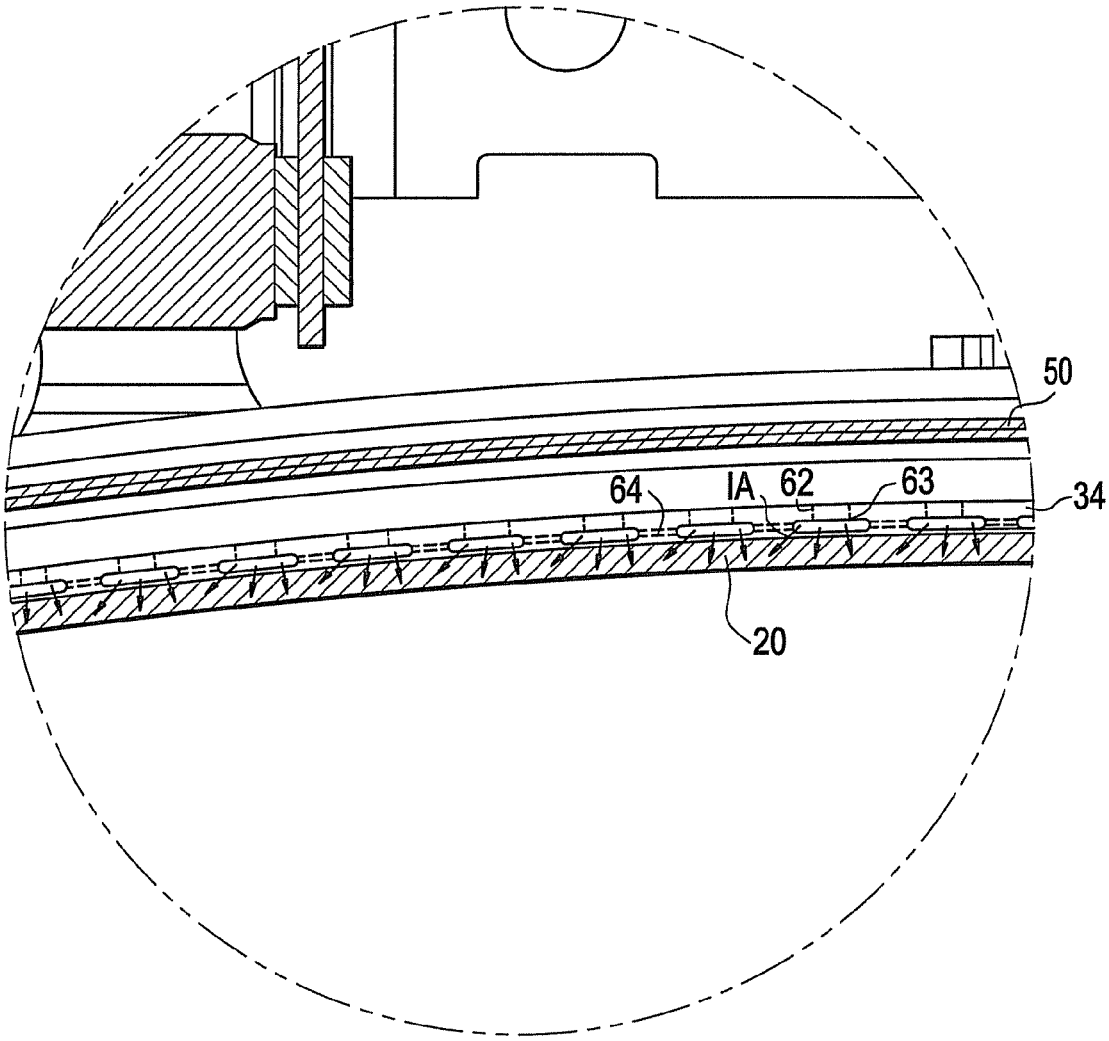
FIG. 3 is a sectional axial view of the transition piece of FIGS. 2A, 2B and 2C taken, in particular, along line 3-3 of FIG. 2A.

With reference to FIGS. 2A, 2B, 2C and 3, it is noted that the embodiments shown in FIGS. 2A 2B and 2C are enlarged images of an aft portion of the transition piece body and the aft frame 30 and that the embodiment of FIG. 3 is a sectional axial view of the transition piece of FIGS. 2A, 2B and 2C taken along line 3-3 of FIG. 2A. As shown in FIGS. 2A, 2B, 2C and 3, the aft frame 30 includes an annular body 31, which is disposed within the outer annular space 23 and at an axial location that is aft of the forward annular space 22. The annular body 31 includes a main portion 32, the outer surface 33, which is oriented to face the outer annular space 23, and a forward surface 34, which is oriented to face the forward annular space 22.

The impingement hole 60 extends through the main portion 32. A fluid path extends through the impingement hole 60 from an inlet 33*a* at the outer surface 33 to an outlet 34*a* at the forward surface 34 such that the outer and forward annular spaces 23 and 22 communicate and, in some embodiments, exclusively communicate.

With the outer annular space 23 and the forward annular space 22 able to communicate with one another through the impingement hole 60, it is possible that high pressure impingement airflow (IA) can be directed to flow from the outer annular space 23 through the impingement hole 60 and toward the forward annular space 22. The impingement airflow in such a case would contact and thereby cool sidewalls 61 of the impingement hole 60. The cooling of the sidewalls 61 increases the cooling of the main portion 32.

The main portion 32 is connected to the transition piece body 20 by, for example, an edge 35 of the main portion 32 being welded to an edge 24 of the transition piece body 20.

An impingement sleeve seal 55 of the impingement sleeve 50 may provide sealing between the outer annular space 23 and the forward annular space 22. Such sealing prevents communications between the outer annular space 23 and the forward annular space 22 except for those communications that occur through the impingement hole 60. The main portion 32 has a seal receptive groove 51 for receiving an end 58 of the impingement sleeve seal 55. As shown in FIG. 2B, in some embodiments, the seal receptive groove 51 is formed with an access port 52 to provide a fluid pathway between an interior of the seal receptive groove 51, which communicates with the outer annular space 23, and the impingement hole 60. As shown in FIGS. 2A and 2C, an additional seal 53 may be received in a second seal receptive groove 54 (see FIG. 2C in particular) for coupling the main portion 32 to a nozzle stage 40.

With reference to FIGS. 2A and 3, the impingement hole 60 may be defined with a first section 62, which may extend through the main portion 32 in a substantially radial direction relative to a central axis of the transition piece body 20, and a second section 63, which may extend through the main portion 32 in a substantially axial direction relative to the central axis of the transition piece body 20. With this configuration, impingement airflow moving into the impingement hole 60 from the outer annular space 23 may initially travel in a substantially radial direction through the first section 62 and then, upon reaching the second section 63, the impingement airflow travels in a substantially axial direction toward the forward annular space 22.

In some embodiments, the impingement hole 60 can be defined as a plurality of impingement holes 60. Here, each one of the plurality of impingement holes 60 may be formed as described above and, in addition, may be arranged in an annular array of impingement holes 60 through the main portion 32 of the annular body 31. The array may be characterized, in some cases, with impingement holes 60 located at uniform perimetric intervals from one another or, in other cases, at preselected perimetric areas of the main portion 32 that are known to experience high operational temperatures and therefore require greater cooling capacity.

Figure 4:
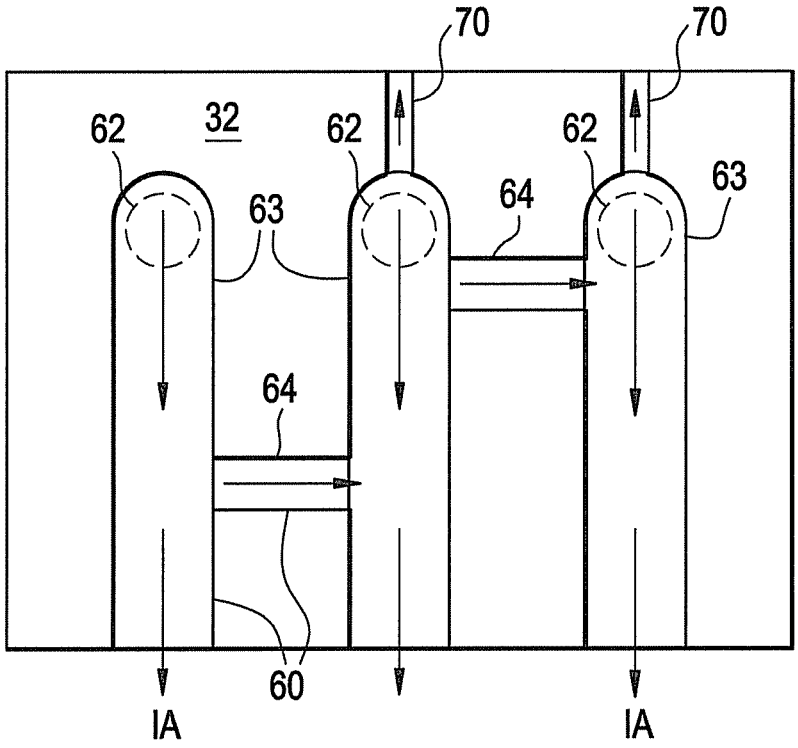
FIG. 4 is a schematic radial view of the aft frame of FIGS. 2A, 2B and 2C.

Referring to FIG. 4, with the impingement hole 60 being defined as a plurality of impingement holes 60, each of the plurality of impingement holes 60 may further be defined with respective third sections 64, which may extend in a substantially perimetric direction and which allow the impingement airflow to proceed from one impingement hole 60 to another in a perimetric direction relative to the central axis of the transition piece body 20 through parts of the main portion 32. In this way, the plurality of impingement holes 60 may be configured to communicate with one another and a greater portion of the main portion can be cooled by way of the impingement airflow.

The third sections 64 may be positioned at various axial and radial positions within the main portion 32. That is, the third section 64 may be positioned to communicate with either or both of the first and second section 62 and 63 of any particular impingement hole 60. In addition, the third sections 64 may be arranged to be axially aligned with one another or, as shown in FIG. 3, they may be arranged in a serpentine configuration in which respective third sections 64 of different impingement holes 60 may extend through the main portion 32 at varied and/or alternating axial locations.

Additional cooling of the main portion 32 may also be provided by an additional impingement hole 70, as shown in FIGS. 2B, 2C and 4. The additional impingement hole 70 extends from the impingement hole 60 toward an aft surface of the main portion 32 and exhausts into an interior 11 defined by the transition piece body 20, the additional seal 53 and the nozzle stage 40. With this configuration, the impingement airflow through the additional impingement hole 70 cools an aft section of the main portion 32.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. An aft frame of a turbine engine including a transition piece body, comprising:

an annular body disposed within a first annular space defined between an impingement sleeve and a compressor discharge casing and aft of a second annular space defined between the transition piece body and the impingement sleeve and including a main portion with a first surface facing the first annular space and a second surface facing the second annular space, the main portion having an impingement hole extending therethrough from an inlet at the first surface of the annular body along a first section that extends in a radial direction and along a second section that extends in an axial direction to an outlet at the second surface of the annular body to define a fluid path along which the first annular space and the second annular space communicate with one another, the first section and the second section being perimetrically localized and an outlet of the first section being defined along a sidewall of the second section.

2. The aft flame according to claim 1, wherein the main portion further comprises an edge connected to an edge of the transition piece body.

3. The aft frame according to claim 1, wherein the main portion further comprises impingement hole sidewalls cooled by impingement flow communicated from the first annular space to the second annular space.

4. The aft frame according to claim 1, further comprising a seal to provide sealing between the first annular space and the second annular spaces.

5. The aft frame according to claim 4, wherein the main portion is formed to define a seal receptive groove that communicates with the impingement hole.

6. The aft frame according to claim 1, wherein the impingement hole is defined with a third section, which extends in a perimetric direction from the sidewall of the second section.

7. The aft frame according to claim 1, wherein the impingement hole is defined as a plurality of impingement holes.

8. The aft frame according to claim 7, wherein each impingement hole of the plurality of impingement holes is defined with a corresponding first section, which extends in the radial direction, and a corresponding second section, which extends in the axial direction.

9. The aft frame according to claim 8, wherein each impingement hole of the plurality of the impingement holes is defined with a corresponding third section, which extends in the perimetric direction between sidewalls of the corresponding second sections of adjacent ones of the plurality of the impingement holes.

10. The aft frame according to claim 7, wherein the plurality of the impingement holes communicate exclusively and directly with adjacent ones of the plurality of the impingement holes.

11. An aft frame of a turbine engine including a transition piece body, comprising:

an annular body disposed within a first annular space defined between an impingement sleeve and a compressor discharge casing and aft of a second annular space defined between the transition piece body and the impingement sleeve and including a main portion with a first surface facing the first annular space and a second surface facing the second annular space, the main portion having an impingement hole extending therethrough from an inlet at the first surface of the annular body along a first section that extends in a radial direction and along a second section that extends in an axial direction to an outlet at the second surface of the annular body to define a fluid path along which the first annular space and the second annular space exclusively communicate with one another, the first section and the second section being perimetrically localized and an outlet of the first section being defined along a sidewall of the second section.

12. The aft frame according to claim 11, wherein the impingement hole is defined with a third section, which extends in a perimetric direction.

13. The aft frame according to claim 11, wherein the impingement hole is defined as a plurality of impingement holes.

14. The aft frame according to claim 13, wherein each impingement hole of the plurality of impingement holes is defined with a corresponding first section, which extends in the radial direction, and a corresponding second section, which extends in the axial direction.

15. The aft frame according to claim 14, wherein each impingement hole of the plurality of the impingement holes is defined with a third section, which extends in a perimetric direction.

16. The aft frame according to claim 13, wherein the plurality of the impingement holes communicate with one another.

17. A turbine engine, comprising:

a compressor discharge casing (CDC);

a transition piece body;

an impingement sleeve disposed to delimit a first annular space with the CDC and a second annular space with the transition piece body; and an annular body, connected to the transition piece body and the impingement sleeve to be disposed within the first annular space and aft of the second annular space, and including a main portion with a first surface facing the first annular space and a second surface facing the second annular space, the main portion having an impingement hole extending therethrough from an inlet at the first surface along a first section that extends in a radial direction and along a second section that extends in an axial direction to an outlet at the second surface to define a fluid path along which the first annular space and the second annular space communicate with one another, the first section and the second section being perimetrically localized and an outlet of the first section being defined along a sidewall of the second section.

18. The turbine engine according to claim 16, further comprising a head end, which is disposed upstream from the transition piece body and which communicates with the second annular space.

* * * * *